US006774549B2

(12) United States Patent
Tsai et al.

(10) Patent No.: US 6,774,549 B2
(45) Date of Patent: Aug. 10, 2004

(54) LAMP STRUCTURE OF LAMP STRING

(76) Inventors: Ching-Yen Tsai, No. 63, Chenggung Rd., Hsinchu (TW), 300; Tsuan-Min Wu, No. 63, Chenggung Rd., Hsinchu (TW), 300

( * ) Notice: Subject to any disclaimer, the term of this patent is extended or adjusted under 35 U.S.C. 154(b) by 2 days.

(21) Appl. No.: 10/225,660

(22) Filed: Aug. 21, 2002

(65) Prior Publication Data

US 2004/0036414 A1 Feb. 26, 2004

(51) Int. Cl.[7] ..... H01J 5/48

(52) U.S. Cl. ..... 313/318.01; 313/318.1; 313/318.12; 362/249; 362/806; 439/356; 439/619

(58) Field of Search ..... 313/49, 51, 318.05, 313/318.09, 318.01; 439/356, 316, 358, 903, 602, 603, 375, 220, 619, 699.2, 611, 612–615, 617–618, 419, 680; 362/226, 806, 267, 123, 252, 391, 249

(56) References Cited

U.S. PATENT DOCUMENTS

| | | | | | |
|---|---|---|---|---|---|
| 5,791,940 | A | | 8/1998 | Chen et al. | 439/619 |
| 5,795,189 | A | * | 8/1998 | Liou | 439/602 |
| 5,989,047 | A | * | 11/1999 | Huang | 439/252 |
| 6,048,076 | A | * | 4/2000 | Lin | 362/249 |
| 6,083,055 | A | * | 7/2000 | Chuang | 439/699.2 |
| 6,113,430 | A | * | 9/2000 | Wu | 439/619 |
| 6,376,974 | B1 | | 4/2002 | Tsai | 313/318.01 |
| 6,623,291 | B1 | * | 9/2003 | Tsai | 439/356 |

* cited by examiner

*Primary Examiner*—Edward J. Glick
*Assistant Examiner*—Elizabeth Keaney

(57) ABSTRACT

A lamp includes a bulb having conductive terminals and a retainer including a cylinder having a top opening for receiving the bulb and a U-shaped support having a bottom with two arms extended towards and connected to lower side of the cylinder for supporting and retaining the bulb in the retainer whereby opposite openings are formed between the support. Projections extend from opposite sides of the support and extend in opposite directions. A partition extends from the bottom of the support and having opposite side faces that are inclined and converge to each other. A socket includes a circumferential wall forming an upper space for receiving the retainer therein and a lower space having a lower opening for extension of the wires. A securing structure is formed on an inside surface of the circumferential wall and corresponds to each of the openings between the support and the cylinder of the retainer. Each securing structure includes two spaced first ribs received in the opening and engaging corresponding arms of the support of the retainer and a second rib for engaging the projection of the retainer to secure the retainer in the socket. Channels are defined in the circumferential wall in the lower space for receivingly engaging the side faces of the partition of the retainer. A conductive pad is mounted to each wire and is located in a chamber formed between the securing structures and the circumferential wall of the socket for engaging the terminals of the bulb.

10 Claims, 8 Drawing Sheets

LAMP STRUCTURE OF LAMP STRING

FIELD OF THE INVENTION

The present invention relates generally to a lamp string comprising a number of lamps connected by electrical wires, and in particular to a size-reduced, watertight lamp structure of the lamp string.

BACKGROUND OF THE INVENTION

Lamp strings are widely used in celebration of holidays and festivals. A lamp string comprises a number of lamps connected by electrical wires. Each lamp comprises a socket attached to the wires and a bulb received in the socket for electrical engagement with the wires. A major concern in the manufacturing of the light string is the reduction of material used. A feasible way is to reduce the dimension of the socket in the direction of bulb insertion. U.S. Pat. No. 6,376,974 discloses a shortened socket for reducing material used. Cutoffs are formed in the socket for further reducing the amount of material used.

Such a conventional socket, although effective in reducing the material used, is not watertight. Since the lamp strings are commonly used outdoors, watertightness is a concern of operation safety of the lamp strings. U.S. Pat. No. 5,791,940 teaches a watertight socket for lamp strings. The conventional watertight socket, however, is difficult to manufacture and has a complicated structure that increases costs and the amount of material used. In addition, part tolerance must be precise in order to achieve watertightness. Further, parts of the socket can be easily separated thereby lacking of operation safety

SUMMARY OF THE INVENTION

An object of the present invention is to provide a lamp string comprising a number of lamps that have a compact structure and thus low costs.

Another object of the present invention is to provide a lamp string comprising a number of lamps of which parts are securely fixed together for operation safety.

A further object of the present invention is to provide a lamp string comprising a number of lamps that have a compact and watertight structure for operation safety and cost reduction.

Yet a further object of the present invention is to provide a lamp structure of a lamp string that is suitable for both two-wire lamp and three-wire lamp.

A further object of the present invention is to provide a lamp structure of a lamp string wherein the lamp comprises a socket defining two isolated chambers respectively accommodating terminals of the lamp for eliminating potential risk of electric shorting.

To achieve the above objects, in accordance with the present invention, there is provided a lamp swing comprising a number of lamps connected by wires. Each lamp comprises a bulb having conductive terminals and a retainer comprising a cylinder having a top opening for receiving the bulb and a U-shaped support having a bottom with two arms extended towards and connected to a lower side of the cylinder for supporting and retaining the bulb in the retainer whereby opposite openings are formed between the two arms of the support. Projections extend from opposite sides of the support and extend in opposite directions. A partition extends from the bottom of the support and having opposite side faces that are inclined and converge to each other. A socket comprises a circumferential wall forming an upper space for receiving the retainer therein and a lower space having a lower opening for extension of the wires. A securing structure is formed on an inside surface of the circumferential wall and corresponds to each of the openings between the support and the cylinder of the retainer. Each securing structure includes two spaced first ribs received in the opening and engaging corresponding arms of the support of the retainer and a second rib for engaging the projection of the retainer to secure the retainer in the socket. Channels are defined in the circumferential wall in the lower space for receivingly engaging the side faces of the partition of the retainer. A conductive pad is mounted to each wire and is located in a chamber formed between the securing structures and the circumferential wall of the socket for engaging the terminals of the bulb.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE INVENTION

Figure 1:
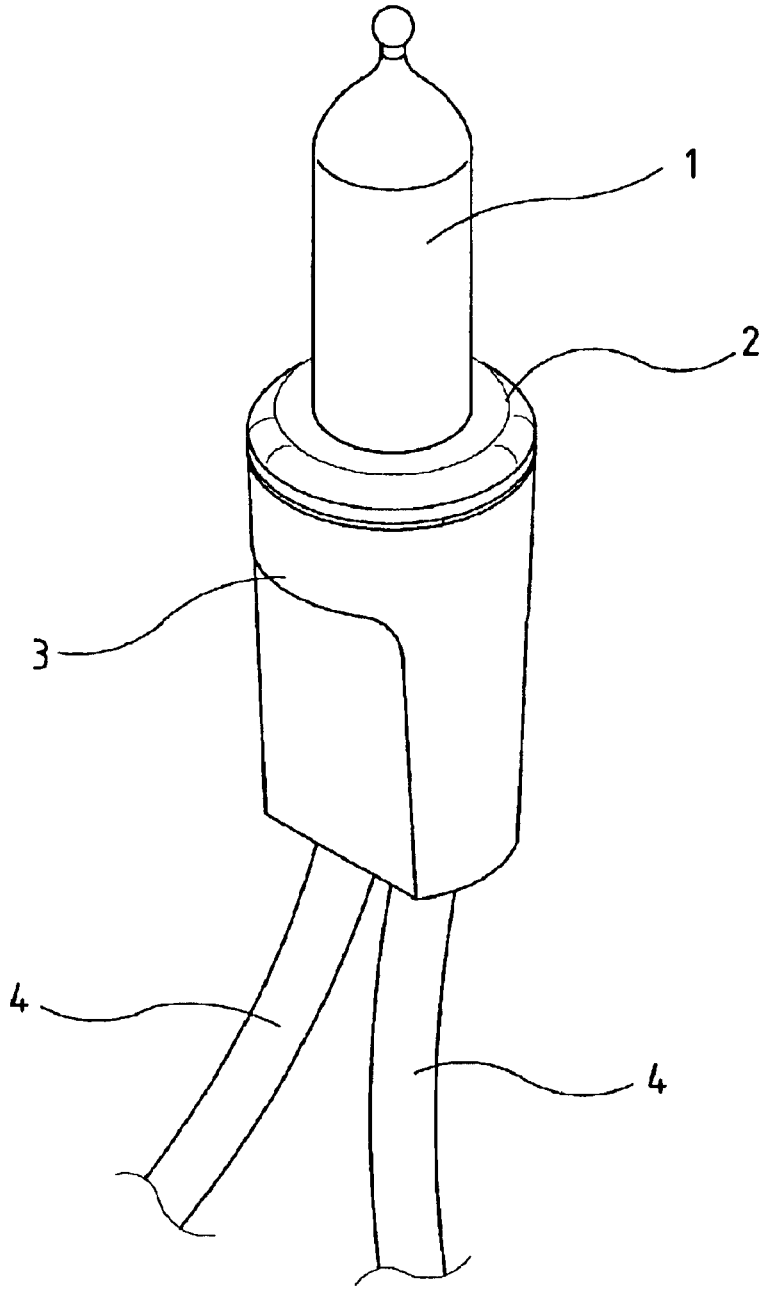
FIG. 1 is a perspective view of a lamp constructed in accordance with the present invention that constitutes partly a lamp string, wires of the lamp string being connected to the lamp.
Figure 2:
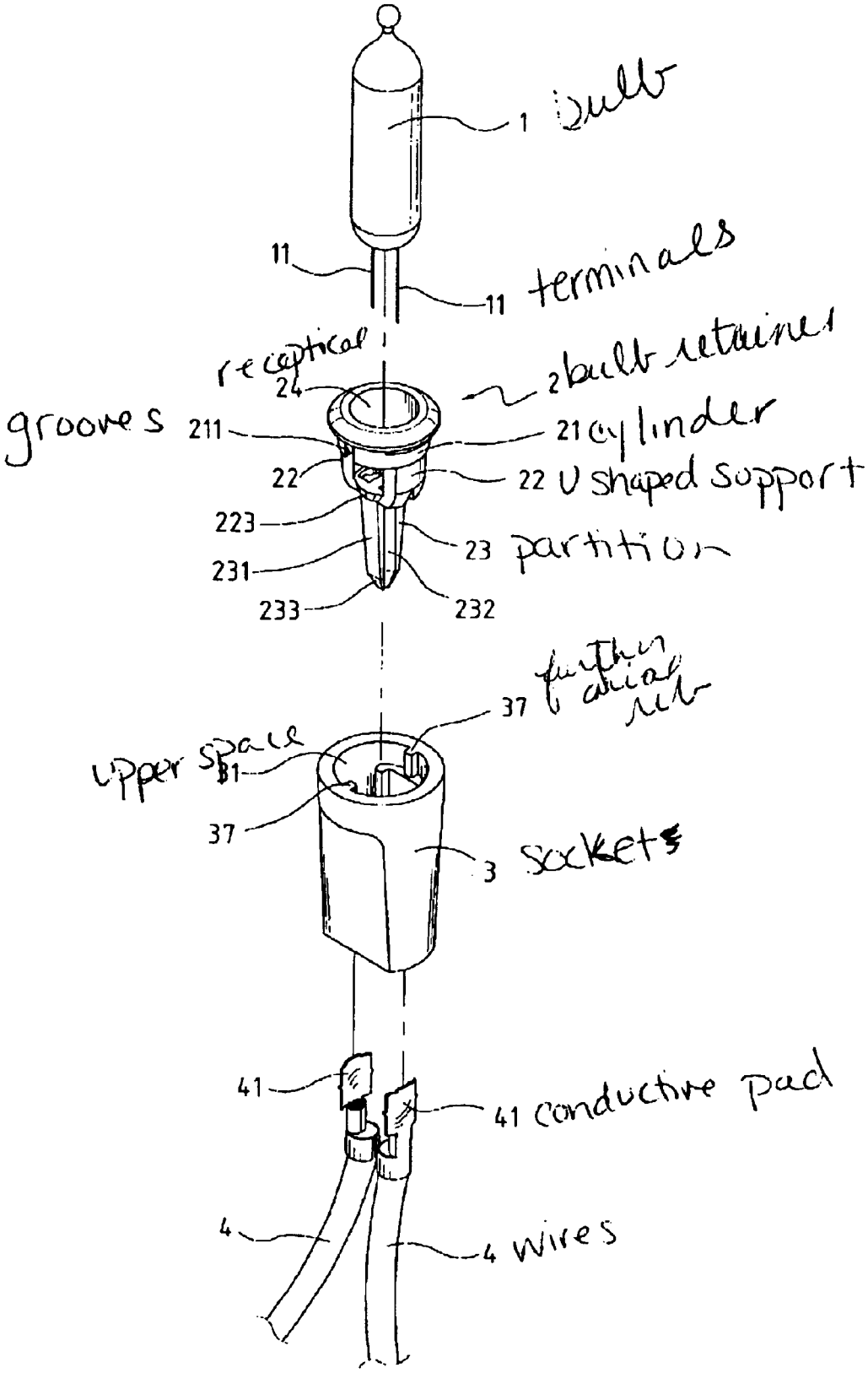
FIG. 2 is an exploded view of the lamp of the present invention.

With reference to the drawings and in particular to FIGS. 1 and 2, a lamp that constitutes in part a lamp string in accordance with the present invention is shown. The lamp comprises a bulb 1 received and retained in a bulb retainer 2, which is in turn fit into and releasably secured in a socket 3. The lamp is connected to wires 4 of the lamp string and forms electrical connection therewith. In this respect, the bulb 1 has two terminals 11 and the socket 3 receives conductive pads 41 of the wires 4 therein whereby when the bulb 1 is fit into the socket 3, the terminals 11 of the bulb 1 respectively and physically engage the conductive pads 41 for electrically connecting the bulb 1 to the wires 4.

Figure 3:
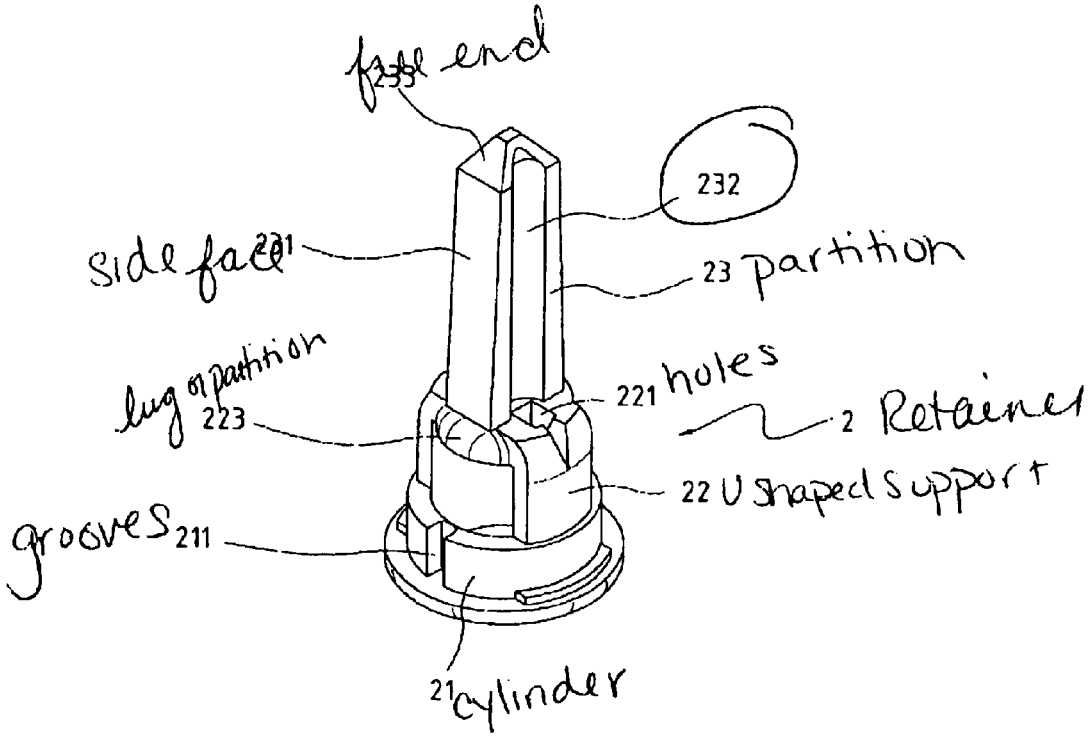
FIG. 3 is a perspective view of a bulb retainer of the lamp in an up-side-down manner.

Also referring to FIG. 3, the retainer 2 comprises a receptacle 24 comprised of a cylinder 21 and a substantially U-shaped support 22 having a bottom with two arms connected to a lower end of the cylinder 21. Two openings (not labeled) are thus defined between the two arms of the U-shaped support 22 an the cylinder 21 on opposite sides of the support 22. The cylinder 21 has an open upper end for receipt of the bulb 1. A partition 23 extends from the bottom of the U-shaped member 22. Two holes 221 are defined in the bottom of the U-shaped member 22 on opposite sides of the partition 23 for the extension of the terminals 11 of the bulb 1. The partition 23 isolates the terminals 11 from each other. Two grooves 211 are defined in an outer surface of the cylinder 21 and extending in a direction substantially parallel to an axis of the cylinder 21.

Figure 4:
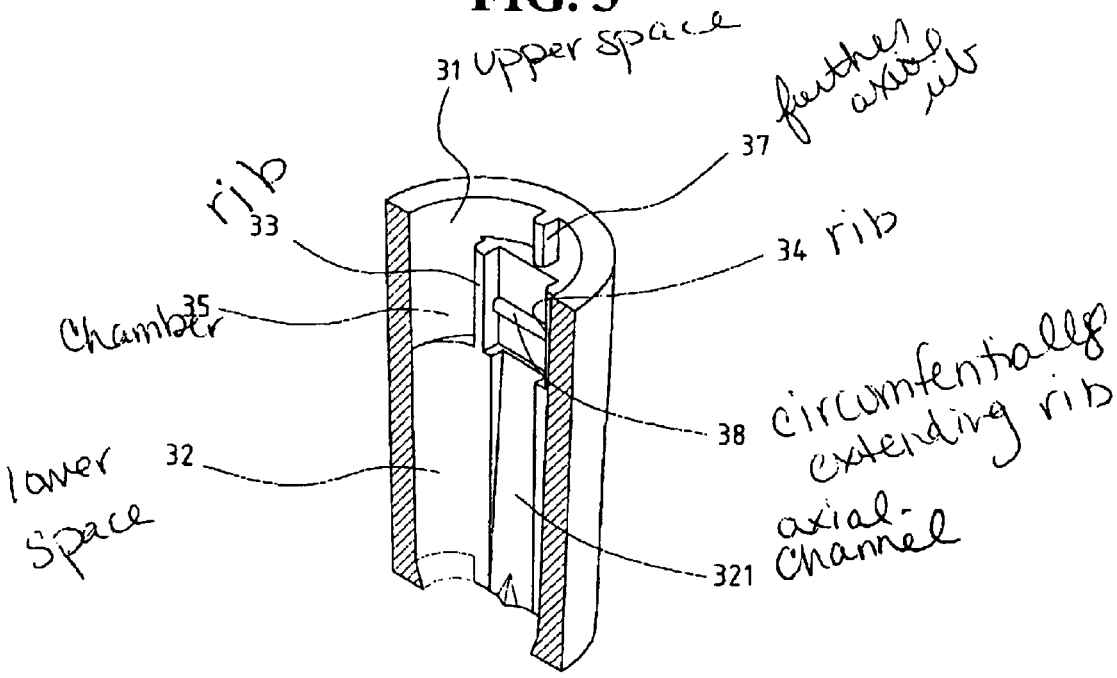
FIG. 4 is a perspective view, partially broken, of a socket of the lamp of the present invention.
Figure 5A:
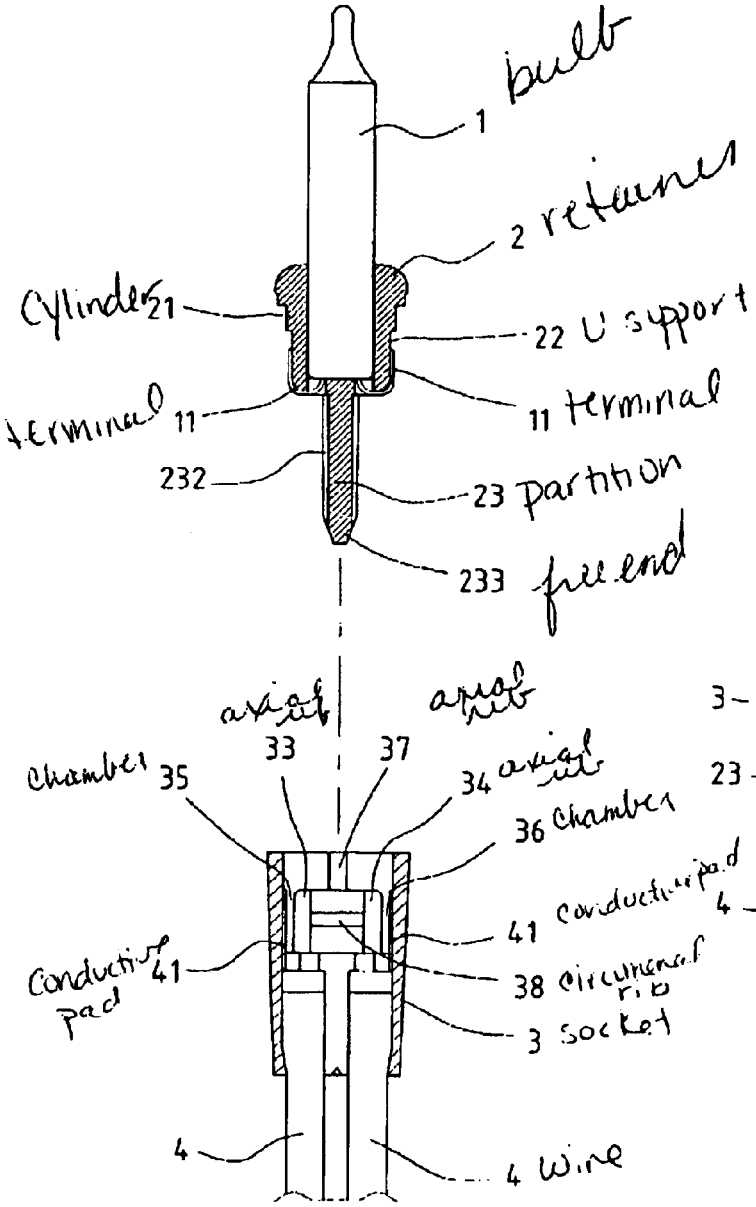
FIG. 5A is a cross-sectional view of the lamp in an exploded condition.
Figure 5B:
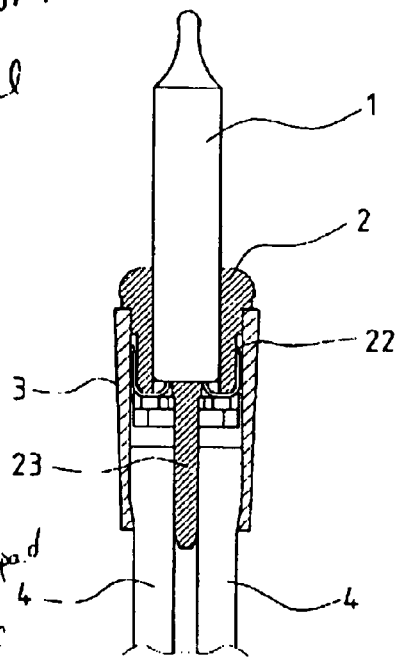
FIG. 5B is a cross-sectional view of the lamp in an assembled condition.
Figure 6:
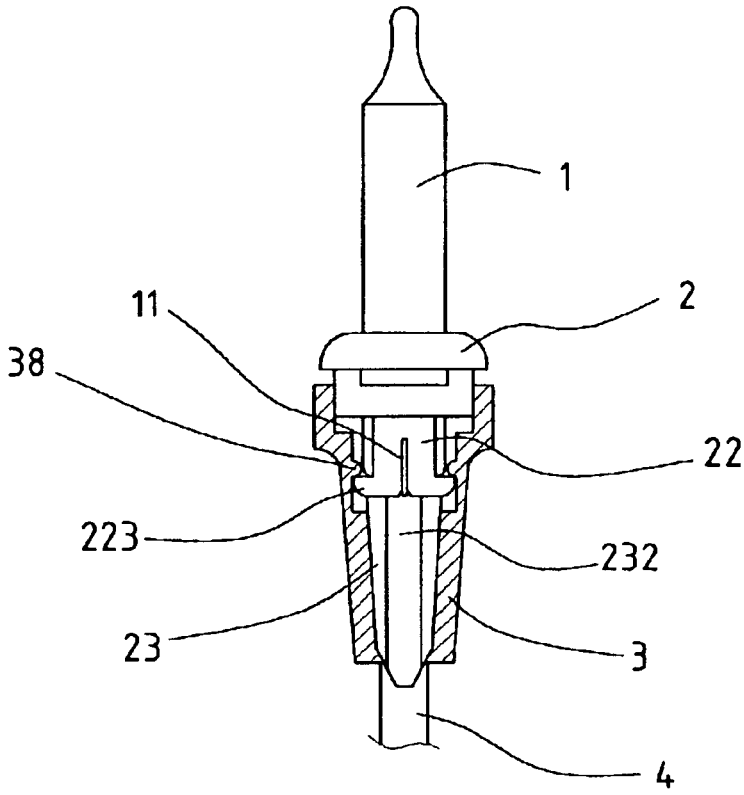
FIG. 6 is another cross-sectional view of the lamp in the assembled condition.
Figure 7:
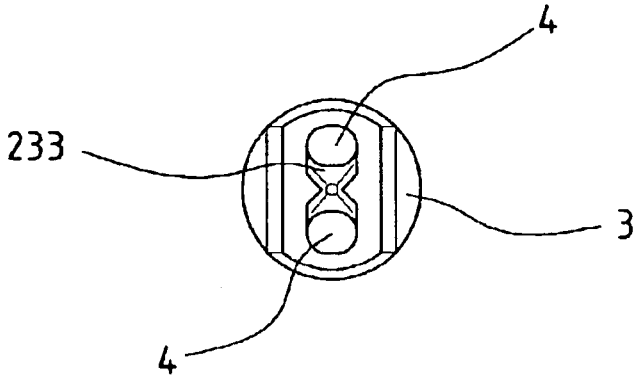
FIG. 7 is a bottom view of the lamp of the present invention.

Also referring to FIG. 4, the socket 3 comprises a circumferential wall defining an upper space 31 for accommodating the retainer 2 and a lower space 32 for accommodating the wires 4. The upper space 31 forms a top opening for receiving the bulb retainer 2 therein. The lower space 32 forms a bottom opening for the extension of the wires 4. Two secure structures are formed on an inside surface of the circumferential wall in the upper space 31 and are substantially opposite to each other. Each securing structure comprises two spaced ribs 33, 34 formed on the inside surface of the circumferential wall and extending in the axial direction of the socket 3. A circumferentially extending rib 38 is formed on the inside surface of the wall and extending between the axially extending ribs 33, 34. The securing structures are respectively received in the openings between the support 22 and the cylinder 21 of the retainer 2 with the ribs 33, 34 of each securing structure abutting against the arms of the support 22 for preventing the retainer 2 from rotation. A further axially-extending rib 37 is formed on the inside surface of the socket wall and receivingly engages each slot 211 of the cylinder 21 of the retainer 2 to further fix the retainer 2. Preferably, a circumferential flange (not labeled) is formed around the upper opening of the receptacle 24 to be supported by an upper end of the socket wall. Two circumferential chambers 35, 36 are defined between the securing structures and are opposite to each other for accommodating the conductive pads 41 of the wires 4.

An axially-extending channel 321 is defined in the inside surface of the circumferential wall of the lower space 32 and extends from each securing structure to the bottom opening of the circumferential wall of the socket 3. With the retainer 2 properly received and fixed in the upper space 31 of the socket 3, the partition 23 extends into the lower space 32 and divides the lower spaces 32 into two sub-spaces respectively for the two wires 4. Preferably, the partition 23 has a sharpened free end 233 for facilitating insertion of the retainer 2 and the partition 23 into the socket 3. The partition 23 comprises opposite first side faces 231 respectively slidably received in the channels 321 of the socket 3 to separate the sub-spaces from each other. Preferably, the transverse side faces 231 are converging to each other in the direction toward the free end 233 of the partition 23.

The partition 23 has opposite second side faces each forming a channel 232 extending from the bottom of the support 22 to the free end 233 of the partition 23 for receiving the wire 4 therein. The wires 4 are received in the sub-spaces of the lower space 32 to locate the conductive pads 41 thereof in the chamber 35, 36 formed in the upper space 31 of the socket In this respect, the first side faces 231 are aligned with the openings of the support 22.

Also referring to FIGS. 5A, 5B, 6 and 7, the wires 4 are lit into the lower space 32 of the socket 3 through the bottom opening of the socket 3 and are respectively located on opposite sides of the channels 321. The bulb 1 is fit into the receptacle 24 of the bulb retainer 2 with the terminals 11 extending through the holes 221 defined in the bottom of the support 22. The terminals 11 are bent over to overlap an outside surface of the corresponding arm of the support 22 and confronting the chamber 35, 36 formed between the securing structures of the socket 3. In this respect, a notch (not labeled) can be formed in each arm of the support 22 to guide the terminal 11 to the outside surface of the arm. By forcibly fitting the retainer 2 (with the bulb 1 retained therein) into the socket 3 through the top opening of the socket 3, the partition 23 of the retainer 2 extends into the lower space 32 in between the wires 4. The partition 23 has a lengthwise dimension such that the sharpened end 233 is located in the bottom opening of the socket 3. The lower space 32 is such that the insertion of the partition 23 into the lower space 32 imposes compression on an outer insulation of each wire 4 that is in general resilient whereby the insulation is resiliently deformed, leading to a tight sealing of the bottom opening between the free end 233 of the partition 23 and the circumferential wall of the socket 3.

The conductive pads 41 of the wire 4 are located in the chambers 35, 36 and engage the terminals 11 of the bulb 1. The upper space 31 of the socket 3 is such that the conductive pads 41 and the terminals 11 are securely interposed between the outer surfaces of the two arms of the support 22 and the circumferential wall of the upper space 31 of the socket 3 to ensure proper electrical engagement between the conductive pads 41 and the terminals 11. The grooves 211 receivingly engage the ribs 37 of the socket 3 which also helps guiding the mounting of the retainer 2 into the upper space 31 of the socket 3 The securing structures comprised of the ribs 33, 34 are fit into the openings between the cylinder 21 and the support 22 of the retainer 2. The bottom of the support 22 forms a lug or projection 223 on opposite sides thereof. The projections 223 extend into the openings between the cylinder 21 and the support 22 and respectively engage the circumferentially extending ribs 38 for securely retaining the retainer 2 in the socket 3. In this respect, each projection 223 has a rounded or inclined bottom configuration for facilitating engagement of the rib 38 with the projection 223.

Figure 8:
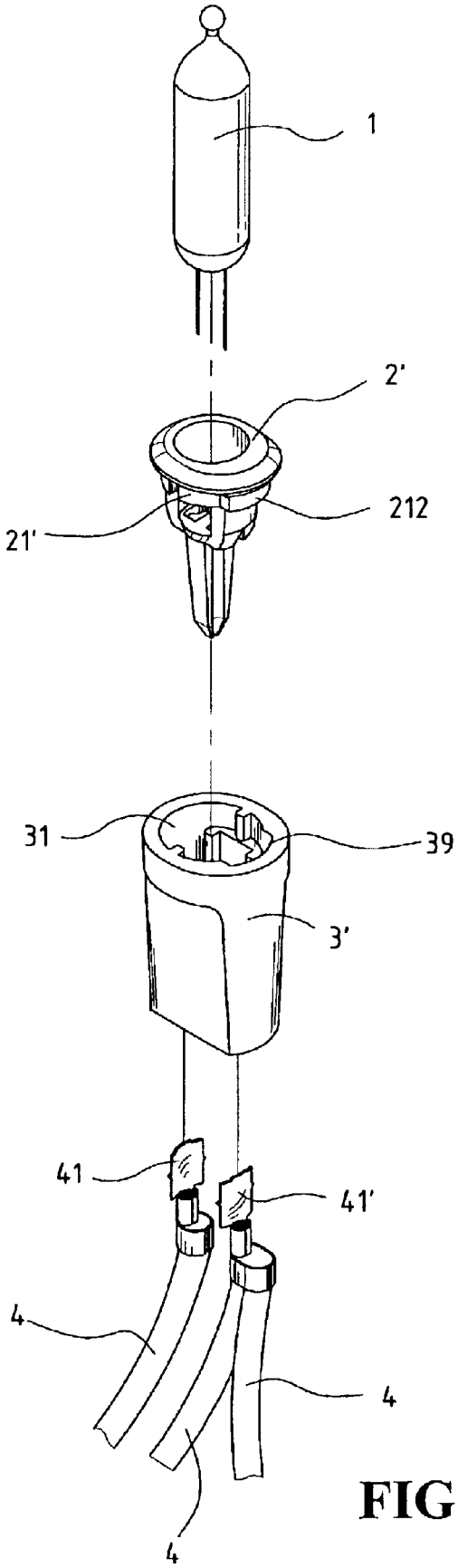
FIG. 8 is an exploded view of a lamp in accordance with another embodiment of the present invention.

FIG. 8 shows a second embodiment of a lamp in accordance with the present invention. The lamp of the second embodiment is connected to a lamp string (not shown) by means of three wires 4 among which the first wire 4 is connected to a conductive pad 41, while the second and third wires 4 are connected to a same conductive pad 41'. The lamp comprises a bulb 1 received and retained in a bulb retainer 2' comprising a cylinder 21' that defines a receptacle for receiving the bulb 1. The retainer 2' is fit in an upper space 31 of a socket while the wires 4 are accommodated in a lower space (not shown) of the socket with the conductive pads 41, 41' located in the upper space 31 to engage the terminals of the bulb 1. The socket 3 comprises an expanded space 39 for accommodating the third wire 4. Corresponding to the expanded space 39, a circumferential rib 212 is formed around the cylinder 21' for being fit into and closing the expanded space 39.

Figure 9:
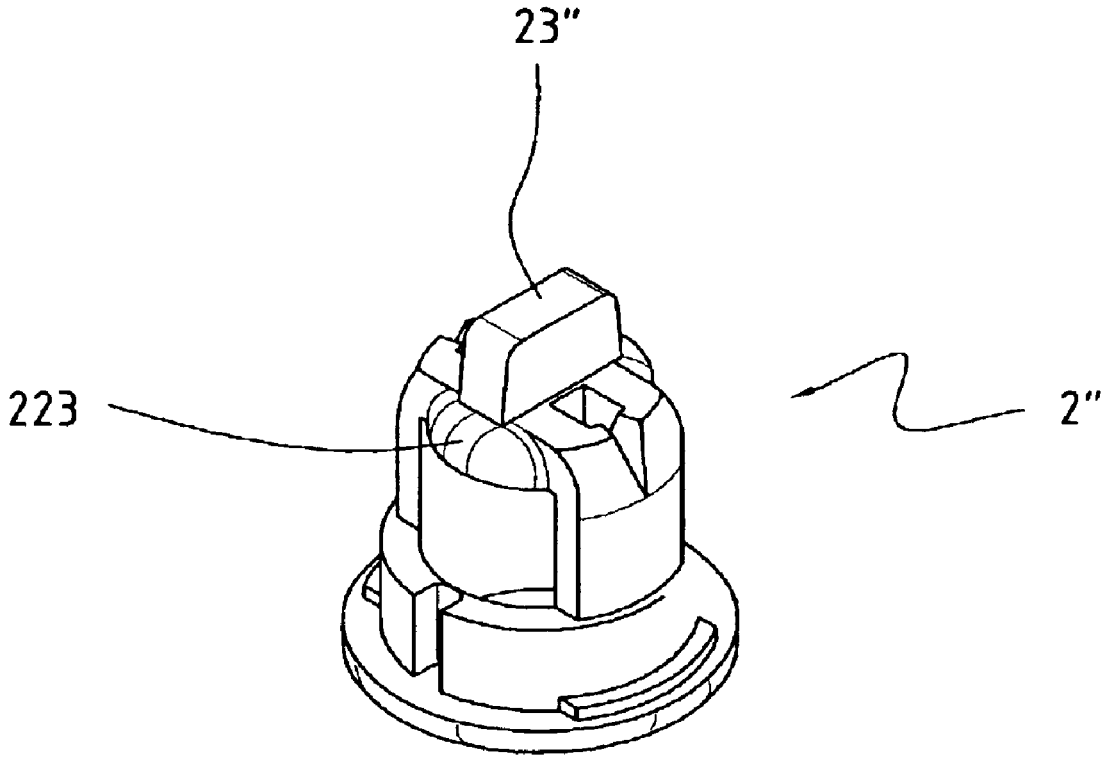
FIG. 9 is a perspective view of a bulb retainer constructed in accordance with a further embodiment of the present invention and shown in an up-side-down manner.

FIG. 9 shows the retainer, which is designated with reference numeral 2", in accordance with a third embodiment of the present invention. The retainer 2" has a partition 23" that has a lengthwise dimension shorter than the partition 23 of the first and second embodiments. Thus, a free end of the partition 23" does not extend to the bottom opening of the socket 3 The partition 23", although effective in separating the conductive pads 41 of the wires 4 from each other, does not have excellent watertightness.

Figure 10:
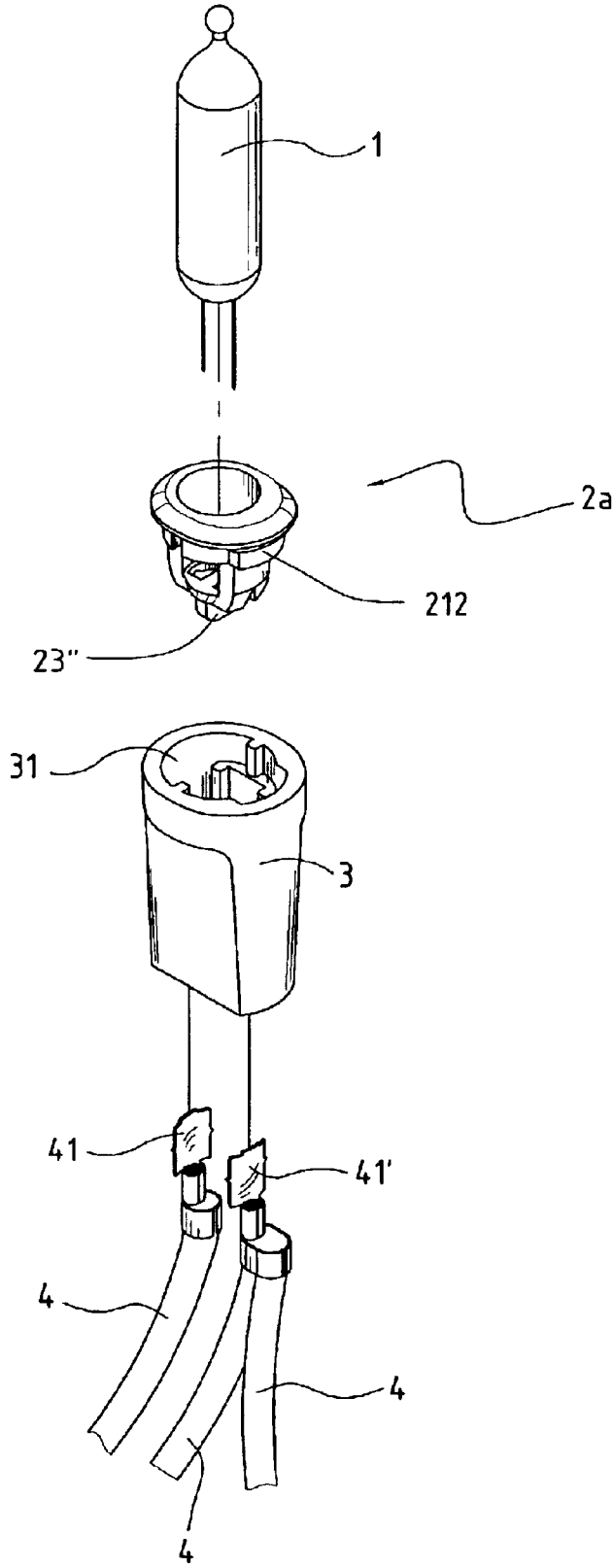
FIG. 10 is an exploded view of a lamp constructed in accordance with yet a further embodiment of the present invention.

FIG. 10 shows a fourth embodiment of a lamp in accordance with the present invention. The lamp of the fourth embodiment is connected to a lamp string (not shown) by means of three wires 4 among which the first wire 4 is connected to a conductive pad 41, while the second and third wires 4 are connected to a same conductive pad 41'. The lamp comprises a bulb 1 received and retained in a bulb retainer 2*a* comprising a cylinder and a U-shaped support mounted to a lower end of the cylinder to form a receptacle for receiving the bulb 1. A partition 23" extends from a bottom of the U-shaped support. The retainer 2*a* is fit in an upper space 31 of a socket while the wires 4 are accommodated in a lower space (not shown) of the socket with the conductive pads 41, 41' located in the upper space 31 to engage the terminals of the bulb 1. The socket 3 comprises an expanded space for accommodating the third wire 4. Corresponding to the expanded space, a circumferential rib 212 is formed around the cylinder of the retainer for being fit into and closing the expanded space. The partition 23" has a lengthwise dimension which is short as compared to an axial length of the lower space of the socket 3. Thus, the partition 23" is mainly for separating the conductive pads 41, 41' from each other, not to provide watertight sealing.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A lamp adapted to be connected to a lamp string by means of wires, the lamp comprising:

a bulb having conductive terminals;

a retainer comprising a cylinder having a top opening for receiving the bulb and a U-shaped support having a bottom with two arms extended towards and connected to a lower side of the cylinder for supporting and retaining the bulb in the retainer, opposite openings being formed between the two arms of the support and the cylinder and on opposite sides of the support, holes being defined in the bottom of the support for extension of the terminals of the bulb, projections extending from opposite sides of the support and extending in opposite directions, a partition extending from the bottom of the support and having opposite side faces that are inclined and converge to each other;

a socket comprising a circumferential wall forming an upper space having an upper opening for receiving the retainer therein and a lower space having a lower opening for extension of the wire, a securing structure formed on an inside surface of the circumferential wall and corresponding to each of the openings between the two arms of the support and the cylinder of the retainer, each securing structure comprising two spaced axially extending ribs received in an opening between the two arms and engaging corresponding arms of the support of the retainer, a circumferentially extending rib being formed on the inside surface for engaging the projection of the retainer to secure the retainer in the socket, channels being defined in the circumferential wall in the lower space for receivingly engaging the side faces of the partition of the retainer; and a conductive pad mounted to each wire and located in a chamber formed between the securing structures and the circumferential wall of the socket for engaging the terminals of the bulb.

2. The lamp as claimed in claim 1, wherein the circumferentially extending rib is formed between the axially extending ribs of each securing structure.

3. The lamp as claimed in claim 1, wherein the projections of the retainer are formed on opposite sides of the bottom of the support and have rounded bottom configuration.

4. The lamp as claimed in claim 3, wherein the projections of the retainer have inclined bottom configuration.

5. The lamp as claimed in claim 1, wherein the inclined side faces of the partition are aligned with the openings of of the support.

6. The lamp as claimed in claim 1, wherein the partition has second side faces each forming a channel for receiving the wire therein.

7. The lamp as claimed in claim 1, wherein the partition has a sharpened end received in the bottom opening of the socket with the wires interposed between the circumferential wall and the sharpened end to seal the bottom opening.

8. The lamp as claimed in claim 1, wherein the lamp is connected to a lamp string by three wires of which first one has first conductive pad and second and third ones have a second conductive pad, the socket having an expanded space for accommodating the third wire, the retainer forming a rib for closing the expanded space.

9. A lamp adapted to be connected to a lamp string by means of wires, the lamp comprising:

a bulb having conductive terminals;

a retainer comprising a cylinder having a top opening for receiving the bulb and a U-shaped support having a bottom with two arms extended towards and connected to a lower side of the cylinder for for supporting and retaining the bulb in the retainer, opposite openings being formed between the two arms of the support and the cylinder and on opposite sides of the support, holes being defined in the bottom of the support for extension of the terminals of the bulb, projections extending from opposite sides of the support and extending in opposite directions, a partition extending from the bottom of the support;

a socket comprising a circumferential wall forming an upper space having an upper opening for receiving the retainer therein and a lower space having a lower opening for extension of the wires, a securing structure formed on an inside surface of the circumferential wall and corresponding to each of the openings between the two arms of the support and the cylinder of the retainer, each securing structure comprising two spaced axially extending ribs received in the opening and engaging corresponding arms of the support of the retainer, a circumferentially extending rib being formed on the inside surface for engaging the projection of the retainer to secure the retainer in the socket; and a conductive pad mounted to each wire and located in a chamber formed between the securing structures and the circumferential wall of the socket for engaging the terminals of the bulb.

10. The lamp as claimed in claim 9, wherein the partition has a lengthwise dimension smaller than an axial dimension of the lower space of the socket.

* * * * *